US008581499B2

(12) United States Patent
Fries et al.

(10) Patent No.: US 8,581,499 B2
(45) Date of Patent: Nov. 12, 2013

(54) METHOD AND SYSTEM FOR DETERMINING SIGNAL STATE

(75) Inventors: Jeffrey Michael Fries, Melbourne, FL (US); Jeffery Armstrong, Palm Bay, FL (US); Robert N. Bettis, West Melbourne, FL (US); Gregory Keith Hann, Odessa, MO (US); Hsien-Kuo Lin, West Melbourne, FL (US); Steve R. Murphy, West Melbourne, FL (US); Daniel G. Penny, III, Melbourne, FL (US); Eric Vorndran, Melbourne, FL (US)

(73) Assignee: General Electric Company, Schenectady, NY (US)

( * ) Notice: Subject to any disclaimer, the term of this patent is extended or adjusted under 35 U.S.C. 154(b) by 284 days.

(21) Appl. No.: 13/108,379

(22) Filed: May 16, 2011

(65) Prior Publication Data

US 2012/0293074 A1 Nov. 22, 2012

(51) Int. Cl.
*H05B 37/02* (2006.01)

(52) U.S. Cl.
USPC ..... 315/130; 315/129

(58) Field of Classification Search
None
See application file for complete search history.

*Primary Examiner* — Crystal L Hammond
(74) *Attorney, Agent, or Firm* — GE Global Patent Operation; John A. Kramer

(57) ABSTRACT

There is provided a method of determining the state of a signal lamp. The method includes receiving time series data corresponding to an electrical signal used to power a signal lamp. The state of the signal lamp can switch from one of the following states to another of the following states: an on state, an off state, and a flashing state. The method also includes determining the state of the signal lamp, based at least in part on both the time series data and an amplitude value of the electrical signal relative to an amplitude-change threshold value over a determined number of amplitude changes.

22 Claims, 5 Drawing Sheets

100

100

300

400

500

METHOD AND SYSTEM FOR DETERMINING SIGNAL STATE

BACKGROUND

1. Technical Field

Exemplary embodiments of the invention relate to a system and method for determining a state of a signal lamp.

2. Discussion of Art

To upgrade to interoperable Positive Train Control (PTC), railroads can implement wayside technologies that enable wireless communications of signal aspect, switch position, and hazard detector status information to the locomotive (or other rail vehicle) and/or a central control facility. In some cases, wayside signaling locations may be controlled by relays or other equipment that cannot be easily upgraded to obtain the signal status information via software. In such cases, information such as switch or signal status can be determined by installing sensors on the wires to the track switches or signal lamps.

Traditional techniques for determining the state of a signal lamp utilize configurable thresholds or a single set of thresholds applicable for a single load type. The thresholds for determining whether these signal lamps are on or off can vary based on the type of device and the accompanying circuitry used in a particular implementation. To further complicate matters, circuits used to flash the signal lamps may not turn the signal lamps fully off during the off portions of a flashing cycle. There are a couple of reasons for this. One is that it reduces the amount of thermal shock to incandescent filaments during flashing, which can prolong their life. The other is that it allows for simpler relay logic to be designed when using special relays that do not respond to the signal when it flashes due to the non-zero current that flows during the off portion of the flash. Therefore, if only off/on thresholds are considered, a set of thresholds may be applicable only to a particular load type and flashing circuit configuration. Due to this, these thresholds may be implemented as a user configurable parameter to take into account the various load types and other variables. While this provides flexibility, it may burden the end user to make sure the thresholds are properly configured not only during initial setup and installation, but anytime the signal lamps are replaced. This may result in a test to determine if the thresholds are properly configured for a given load type. For example, if a signal maintainer replaces an 18 W bulb that has burned out with a 25 W bulb, the thresholds must be reconfigured and a test performed to verify the thresholds properly detect the state of the new load type.

BRIEF DESCRIPTION

Briefly, in accordance with an embodiment, there is provided a method of determining the state of a signal lamp. The method includes receiving time series data corresponding to an electrical signal used to power a signal lamp. The state of the signal lamp can switch from one of the following states to another of the following states: an on state, an off state, and a flashing state. The method also includes determining the state of the signal lamp, based at least in part on both the time series data and an amplitude value of the electrical signal relative to an amplitude-change threshold value over a determined number of amplitude changes.

In another embodiment, there is provided a system that includes a receiver for time series data of a detected electrical signal being delivered to a signal lamp. The state of the signal lamp can switch from one at least one of the following states to another of the following states: an on state, an off state, and a flashing state. The system also includes a controller in communication with the receiver. The receiver determines the state of the signal lamp based on the time series data, and determines whether the signal lamp is in a flashing state based on an amplitude value of the electrical signal relative to an amplitude-change threshold value over a specified number of amplitude changes.

In another embodiment, there is provided a system for determining a state of a signaling device. The system includes a signal lamp configured to indicate a condition of a railway as a function of a state of the signal lamp. The signal lamp is controlled by the signaling device. The system also includes a sensor coupled to the signal lamp and configured to detect an electrical signal powering the signal lamp. The system also includes a signaling aspect processor coupled to the sensor. The signaling aspect processor includes a data storage device and a data acquisition unit configured to receive the electrical signal detected by the sensor and save time series data of the electrical signal to the data storage device. The system also includes a processing unit configured to determine the state of the signal lamp based on the time series data, wherein the state of the signal lamp is identified as flashing if the electrical signal varies by greater than a specified amplitude-change threshold over a specified number of amplitude changes within a specified flash-detection time interval.

The system may include a signal lamp configured to indicate a condition of a railway. The system may also include a sensor coupled to the signal lamp and configured to detect a voltage or current powering the signal lamp. The system may also include a signaling aspect processor coupled to the sensor. The signaling aspect processor may include a data storage device and a data acquisition unit configured to receive the voltage or current detected by the sensor and save the voltage or current to the data storage device as time series data. The signaling aspect processor may also include a processing unit configured to determine the state of the signal lamp based on the time series data, wherein the state of the signal lamp is identified as flashing if the voltage or current varies by greater than a specified amplitude change threshold over a specified number of transitions within a specified flash-detection time interval.

DRAWINGS

These and other features and aspects of embodiments of the invention will become better understood when the following detailed description is read with reference to the accompanying drawings in which like characters represent like parts throughout the drawings, wherein.

DETAILED DESCRIPTION

Exemplary embodiments of the invention relate to a system and method for determining a state of a signal lamp. Such exemplary embodiments may relate to determining the state of a signal lamp used in positive train control systems such as wayside control systems.

Figure 1:
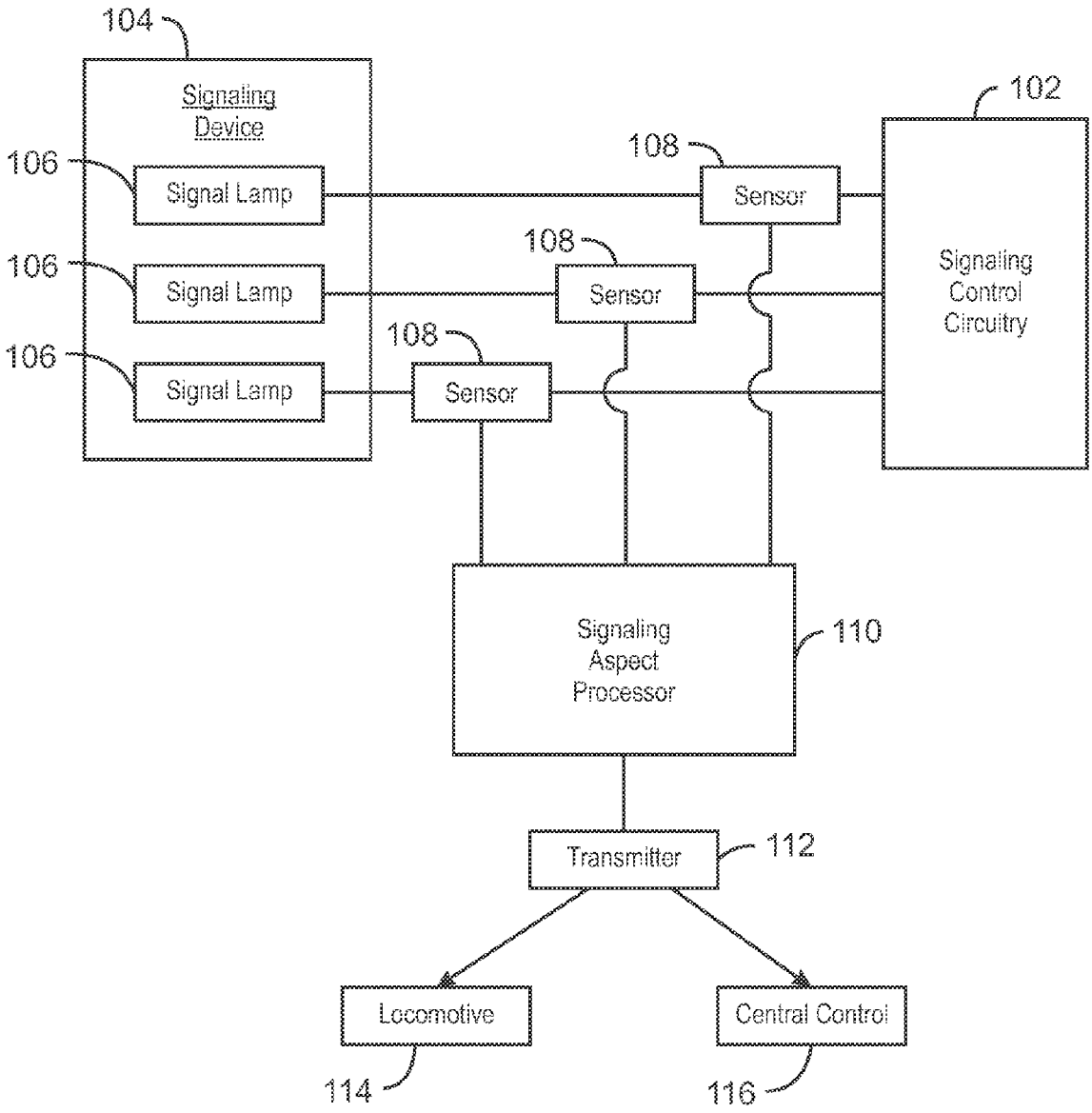
FIG. 1 is a block diagram of a railway signaling system, according to an exemplary embodiment of the invention.

FIG. 1 is a block diagram of a railway signaling system according to an exemplary embodiment of the invention. The railway signaling system is referred to be the reference number 100. In embodiments, the railway system 100 may be configured to provide information to a train conductor regarding the state of the railway. For example, the system 100 may be configured to communicate a track switch state or whether a hazard condition exists, such as track flooding, obstructions, and the like. The system 100 can include signaling control circuitry 102 configured to determine a track condition and communicate the information to the signaling device 104.

The signaling control circuitry 102 can be implemented using relays or solid state devices and can include one or more detectors, such as train detection, light out detection, switch state detectors, high water detectors, and slide fence detectors, among others. The signaling control circuitry 102 can then communicate the information to the conductor through the signaling device 104 by energizing one or more signal lamps 106. The signaling device 104 may be positioned along the track at a location viewable by the conductor. A variety of information can be communicated to the conductor based on the combination of signal lamps 106 that are energized. The overall state of the signaling device 104, based on the combination of signal lamps 106 that are energized, is referred to as the "signal aspect" of the signaling device 104. The signal aspect can inform the conductor regarding his authority to move, the presence of hazards, as well as other information. In railway signaling systems 100, more permissive conditions may be indicated by energizing or flashing signal lamps, whereas more restrictive conditions may be indicated by de-energizing signal lamps.

In embodiments, the system can also include sensors 108 used to sense the signal aspect of the signaling device 104. The sensors 108 may be disposed parallel to, or in series with, the conductors used to energize the signal lamps 106. In this way, each sensor can detect the voltage and/or current being applied to its associated signal lamp to determine whether the corresponding signal lamp is on, off, or flashing. As used herein, the term "electrical signal" may be used to refer to the voltage, current, or both the voltage and current being applied to the signal lamp. Further, the sensors 108 may be contained within the same housing as the signaling control circuitry 102 or the signaling device 104.

The system 100 can also include a signaling aspect processor 110 operatively coupled to the sensors 108 and a transmitter 112 operatively coupled to the signaling aspect processor 110. Output from the sensors 108 can be sent to the signaling aspect processor 110, which may be configured to determine the signal aspect based on the combination of on, off, and flashing signal lamps. The signaling aspect processor 110 can then communicate the signal aspect through the transmitter 112. In embodiments, the transmitter 112 is a wireless transmitter that communicates the signal aspect to a locomotive or other rail vehicle 114. In this way, the signal aspect can be transmitted to a computer onboard the locomotive or other rail vehicle to enforce the signal before it is visible to the conductor. Further, the signal aspect can be transmitted to a central control facility 116.

In an embodiment, the signaling aspect processor 110 uses a set of universal thresholds and various timing criteria for determining whether a particular signal lamp is on, off, or flashing. By "universal" thresholds, it is meant thresholds that may be applied for all expected load types. (The expected load types may include a plurality of loads, such as plural types/ratings of incandescent lamps, LEDs, and the like. In one embodiment, the universal thresholds are applicable to a plurality of discrete potential loads. Such discrete loads correspond to application specific light sources, including LEDs and at least three incandescent lamps, each having a different power rating, e.g., 12 W, 18 W, and 25 W.) Thus, the load of the signal lamp may be changed without re-adjusting the thresholds. For example, a signal lamp bulb may be replaced with a new bulb of a different wattage rating and the signaling aspect processor will still perform as intended using the same set of universal thresholds. In an embodiment, the signaling aspect processor acquires a window of data from the sensors over a certain time frame. The data may be analyzed based on the universal thresholds and other timing criteria used to distinguish between signal states of off, on, or flashing. Embodiments of the signaling aspect processor 110 can be better understood with reference to FIG. 2.

Figure 2:
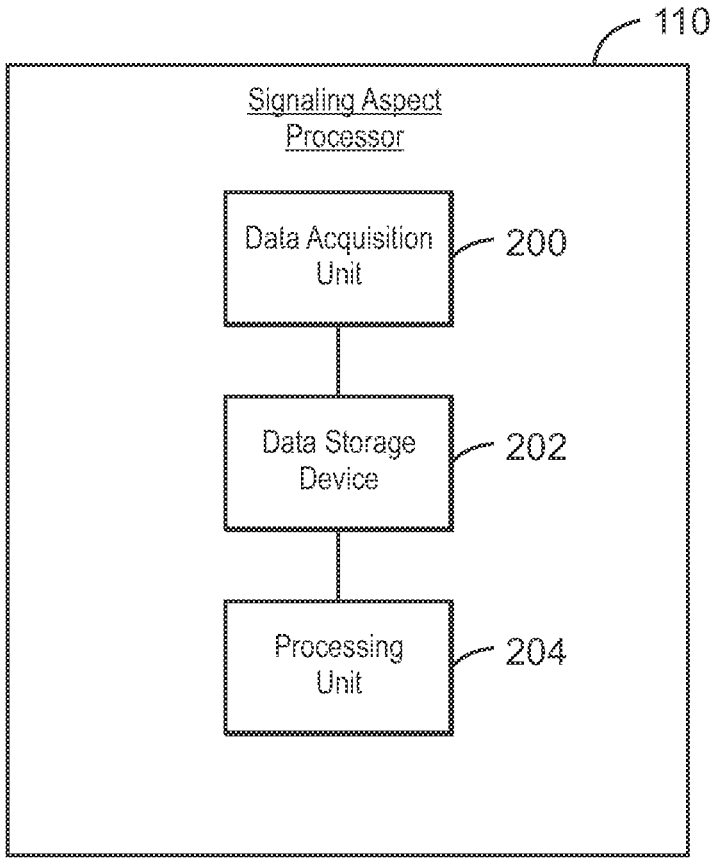
FIG. 2 is a block diagram of a signaling aspect processor, according to an exemplary embodiment of the invention.

FIG. 2 is a block diagram of a signaling aspect processor, according to an exemplary embodiment of the invention. The signaling aspect processor 110 may include a data acquisition unit 200, a data storage device 202, and a processing unit 204. The signaling aspect processor 110 may be implemented as a set of discrete components such as separate computer chips and logic devices, and may include analog and digital components. The signaling aspect processor 110 may also be implemented as a single integrated circuit, such as an Application Specific Integrated Circuit (ASIC), or a Field Programmable Gate Array (FPGA), for example. The data storage device 202 may be any suitable non-transitory, computer-readable media, including volatile and non-volatile memory. For example, the data storage device 202 may include static random access memory (SRAM), dynamic random access memory (DRAM), and flash memory, among others. The data storage device may also include a data buffer, such as a circular buffer. In an embodiment, the data storage device 202 also includes processor-implemented instructions, such as programming code for performing the methods described herein. The non-transitory, computer-readable media can be read by any suitable type of computing device, such as a general-purpose computer or a dedicated processor such as an ASIC, an FPGA, and the like.

The data acquisition unit 200 may be configured to receive and/or acquire electrical signal data from the sensors 108, wherein the electrical signal may be a voltage, current, or both voltage and current being applied to the signal lamps. The data acquisition unit can include, for example, an analog-to-digital converter, digital signal processor, and the like. The data acquisition unit 200 may sample the voltage and/or current detected by the sensors 108 at regular time intervals and store the acquired data to the data storage device 202 as a set of time series data (meaning multiple data points correlated to respective time information). The time series data stored to the data storage device 202 may span a sufficient time period to enable analysis of the data as described herein. For example, the amount of data held in the storage device 202 at any time may span a time period equal to or greater than the elapsed time of several signal lamp flashes. In one embodiment, a flash cycle may be in a range of from approximately 0.8 seconds to about 1.75 seconds. Here, and elsewhere where ranges are employed, unless specifically provided otherwise the range may include subsets of values that fall within the exemplary range values given. In an embodiment, the time series data stored to the data storage device 202 may cover several days, weeks, or months worth of data, which may be used, for example, to analyze the long term performance of the signaling system 100.

The processing unit 204 receives the time series data from the storage device 202 and processes the data to determine the state of each signal lamp 106. The processing unit 204 also determines the overall signal aspect (of the signaling device) based on the state of each signal lamp 106. The state of each signal lamp 106 may be identified as off, on, or flashing. Further, the state of each signal lamp 106 may be determined using a universal state detection mode. The term "universal state detection mode" refers to a signal state detection technique that can be applied uniformly to any of a plurality of differently-configured signal lamps, thus eliminating re-calibration or other human input that may otherwise be used when replacing a first signal lamp with a second differently-configured signal lamp. For example, the universal state detection mode may use a set of universal thresholds applicable to all supported signal types and circuit configurations. The universal threshold values are discussed further below in reference to FIG. 3. A method for determining the state of each signal lamp 106 using the universal thresholds is discussed further below in reference to FIG. 4.

Figure 3:
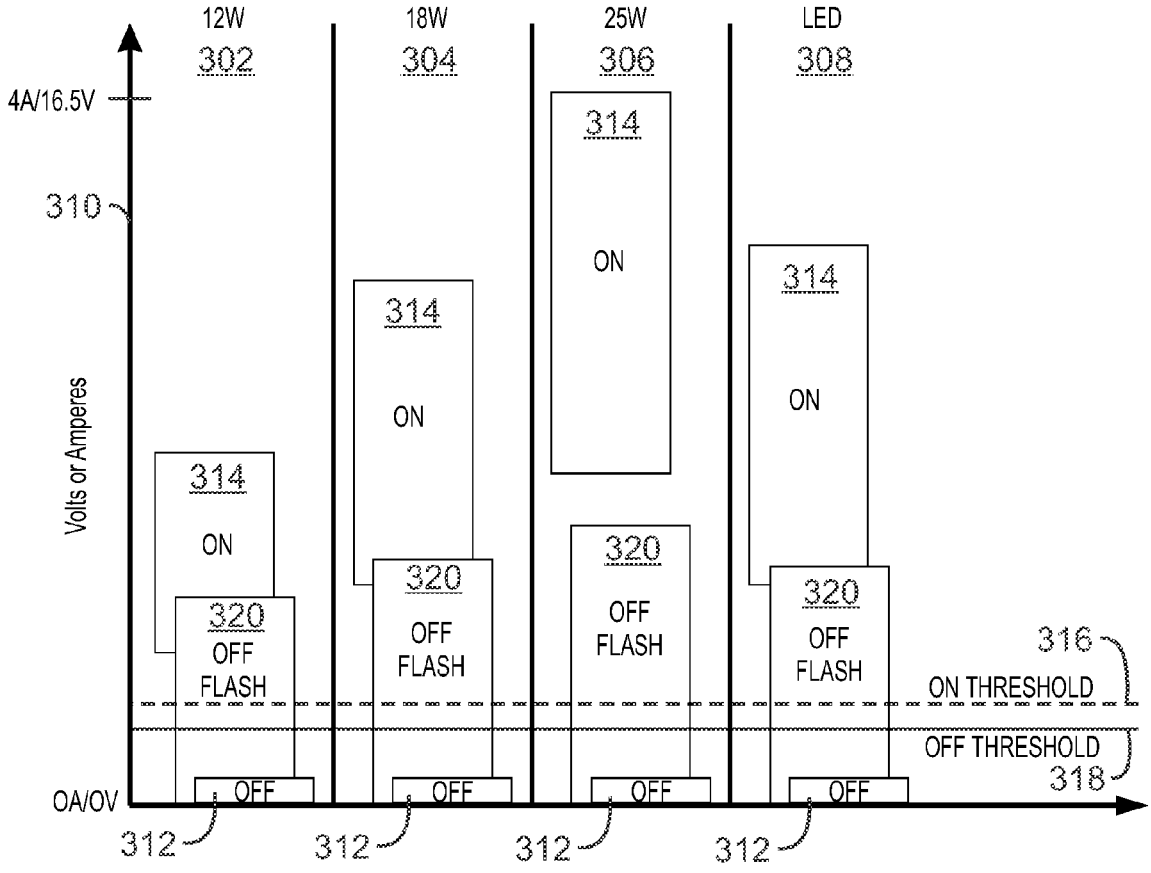
FIG. 3 is a chart of signal lamp data used to determine a set of universal thresholds, according to an exemplary embodiment of the invention.

FIG. 3 is a chart of signal lamp data illustrative of a method/process to determine a set of universal thresholds, according to an exemplary embodiment of the invention. The chart 300 shown in FIG. 3 contains four columns of data, each column representing a particular type of load, for example, different bulb types. The first column 302 represents signal lamp data acquired for a 12 watt incandescent bulb. The second column 304 represents signal lamp data acquired for an 18 watt incandescent bulb. The third column 306 represents signal lamp data acquired for a 25 watt incandescent bulb. The forth column 308 represents signal lamp data acquired for an LED signal. The four columns of data shown in FIG. 3 represent all of the expected load types that may be present in an embodiment of the signaling device 104 (FIG. 1). However, the load types shown in FIG. 3 are but a few examples of the expected load types that may be encountered. The universal thresholds will support a range of expected signal lamp types. In the event that another signal lamp type is encountered that should fall between the characteristics of the lowest and highest wattage type, it is anticipated that those signal lamp types will be compatible with the system.

The vertical axis 310 represents the ranges of current and/or voltage values possible for a particular load type, given all the variables possible. These variables may include, but are not limited to, the following: the source voltage of the battery banks or lighting transformers, gauge and length of the wire to the signal lamps, location of the sensor 108 within the circuit, environmental factors such as temperature, type of flashing circuits used, and whether multiple signal lamps share a common return wire, among others. The regions 312 marked as OFF indicate the range of current or voltage possible, given all variation, when the signal lamp 106 is intended to be off. Similarly, the regions 314 marked as ON indicate the range of current or voltage possible, given all variation, when the signal lamp 106 is intended to be on. As shown in FIG. 3, there is considerable separation between the low point of each ON region 314 and the high point of each OFF region 312. Accordingly, universal threshold values that are applicable to all of the expected load types may be specified. The universal threshold values may include a threshold value referred to herein as an "ON threshold," 316 used to determine whether the signal lamp is in an on state. Additionally, the universal threshold values may include a threshold value referred to herein as an "OFF threshold," 318 used to determine whether the signal lamp is in an off state.

In an embodiment, the ON threshold 316 and the OFF threshold 318 may be set to any value between the lowest current or voltage value exhibited by any ON region 314 and the highest current or voltage value exhibited by any OFF region 312. Further, the OFF threshold 318 may be set to a value equal to or less than the ON threshold 316. In an embodiment, the ON threshold 316 may be set to approximately 4 to 6 volts or 400 to 750 milliamperes, and the OFF threshold 318 may be set to approximately 2 to 4 volts or 100 to 400 milliamperes. For example, in a particular implementation the ON threshold 316 may be set to approximately 5.6 volts or 600 milliamperes, and the OFF threshold 318 may be set to approximately 4 volts or 400 milliamperes, as shown in FIG. 3. However, it will be appreciated that other embodiments may use any ON threshold 316 or OFF threshold 318 suitable for a particular implementation. In an embodiment, a single combined ON/OFF threshold may be used instead of the separate ON threshold 316 and OFF threshold 318.

The regions marked as OFF FLASH 320 indicate the range of current or voltage possible, given all variation, when the signal lamp 106 is in the off portion of a flash. The OFF FLASH 320 regions may be affected by the types of flashing circuits used in railway signaling systems. For example, some flashing circuits may include solid state flashers (current or voltage regulated) or relay flashers. Solid state flashers may partially turn off their regulated supply to the signal lamp during the off portion of the flash. Relay flashers may include various resistors in parallel with their contacts to provide current or voltage to the signal lamp during the off portion of the flash. The value of the parallel resistor largely determines the value of current or voltage present during the OFF FLASH condition. Investigation of the various flashing methods results in the range of the OFF FLASH regions 320 for the various load types as shown in FIG. 3.

To simplify light out detection circuits and reduce the thermal shock to the filaments during flashing, flashing circuits may not always turn the signal lamps 106 completely off during the off portion of a flash. Thus, it can be seen from FIG. 3 that even for a single load type, the OFF FLASH region 320 can span both the OFF region 312 and ON region 314. Accordingly, it may not be possible to use a universal set of OFF and ON thresholds alone to determine if the signal lamp 106 is flashing.

Investigation of the commonly used flashing methods reveals that for a given set of variables, there can be derived a minimum amount of change in the current or voltage when transitioning between the off and on portions of a flash. The universal thresholds can include an amplitude-change threshold, which may be specified based on the minimum amount of change in the current or voltage observed during the flashing condition for a wide variety of loads and circuit configurations. In an embodiment, the flashing state of a signal lamp may be identified based, in part, on the relative change in current and/or voltage powering the signal lamp as compared to the amplitude-change threshold. A set of timing criteria may be used to distinguish the flashing state from a transition between the on state and the off state, as described below in relation to FIG. 4.

The signal aspect processor 110 (FIG. 1) may also determine whether the signal lamp is in the on portion of a flash or the off portion of a flash. In an embodiment, this determination is made based on the slope of the change in the current and/or voltage powering the signal lamp 106. In an embodiment, the absolute value of the voltage or current powering the signal lamp is compared to the ON threshold 316 to determine if the current and/or voltage is in the on or off portion of a flash.

The common set of universal thresholds, including the ON threshold 316, the OFF threshold 318, and the amplitude-change threshold, enables the use of a universal method for identifying the various states of the signal lamps 106. In this way, the system calibration performed at initial setup and installation or anytime the signal lamps 106 are replaced, may be eliminated. The use of universal thresholds also reduces the likelihood that thresholds may be configured improperly, for example, due to human error.

Figure 4:
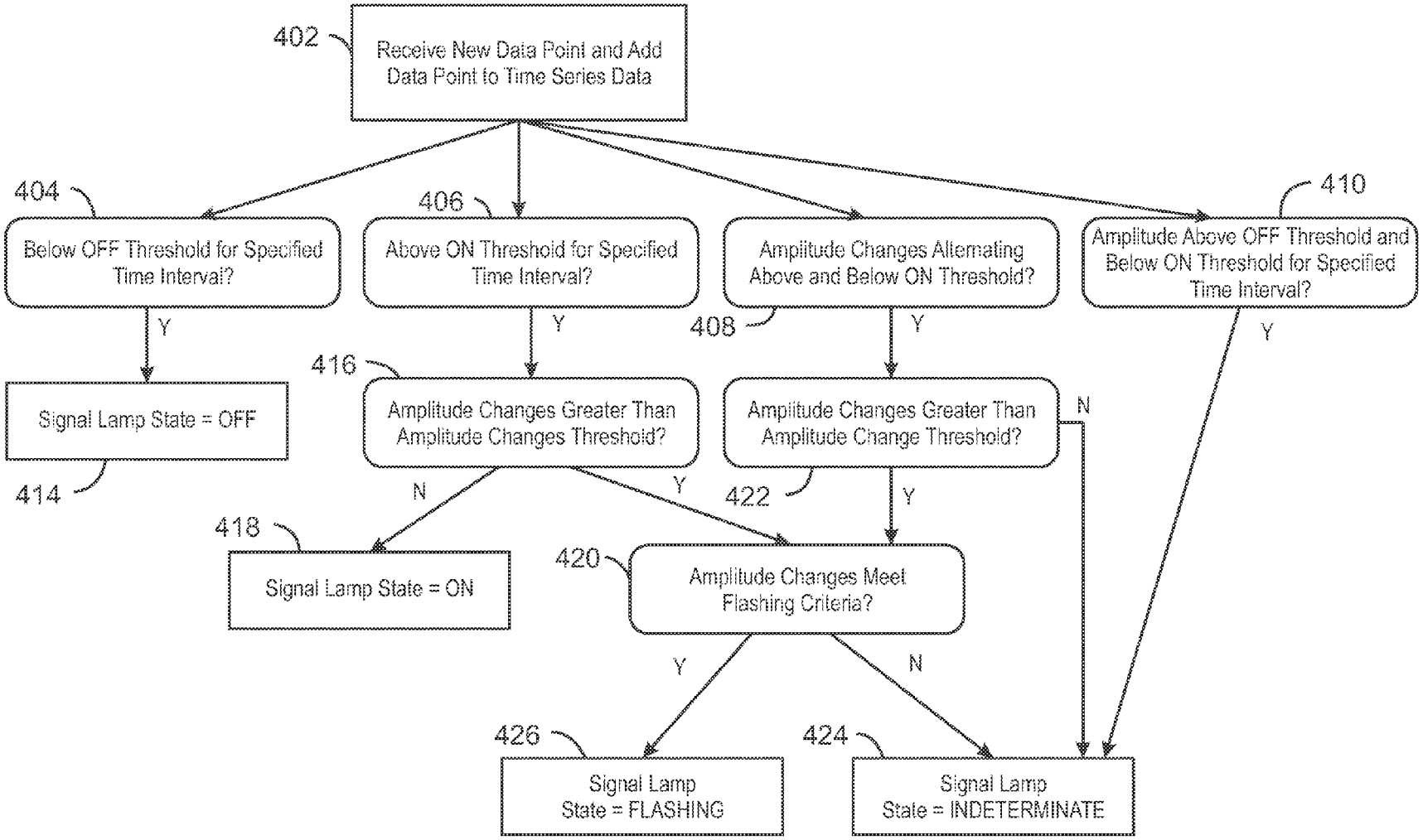
FIG. 4 is a process flow diagram of a method of determining the state of a signal lamp, according to an exemplary embodiment of the invention.

FIG. 4 is a process flow diagram of a method of determining the state of a signal lamp, according to an exemplary embodiment of the invention. The method is referred to with the reference number 400 and may be performed by the signaling aspect processor 110 shown in FIGS. 1 and 2. As disclosed herein, the state of the signal lamps may be determined by comparing the time series data collected from the sensors 108 with the universal thresholds, amplitude-change threshold, and applying a set of timing criteria. In an embodiment, the method 400 may be performed at regular intervals, for example, each time a new data point is added to the time series data.

At block 402, a new data point is received and added to the time series data. The data point may describe the electrical signal sensed by the current sensor 108 and corresponds with the voltage, current or both the voltage and current powering the signal lamp at a given point in time. In an embodiment, the oldest data point may be erased from the data storage device to accommodate the new data point. The time series data over a specified time frame may then be analyzed to identify the state of the signal lamp 106. In an embodiment, the time series data are analyzed by making the determinations described below in blocks 404, 406, 408, and 410. Blocks 404, 406, 408, and 410 may be performed in parallel or serially in any order. As described below, determining the state of the signal lamp may include determining the amplitude of the current or voltage indicated by the time series data. When a lamp changes state, there may be some overshoot/undershoot and settling that happens due to the dependency of the filament resistance on temperature. In an embodiment, determining the amplitude of the current or voltage may include waiting for a period of time after any state transition to let the filament cool before analyzing the amplitude that is used in the lamp state determination algorithms. For example, any time that a transition in the voltage or current occurs, the voltage or current data obtained within the waiting period may be ignored. In an embodiment, the waiting period may be approximately 150-200 milliseconds.

At block 404, a determination is made regarding whether the current and/or voltage indicated by the time series data has been below the OFF threshold for a specified time interval. In an embodiment, the specified time interval is based on the timing parameters of the corresponding flashing circuit and may be approximately one to three seconds. The time ratio of the on and off portions of a single flash is described by the duty cycle of the flashing circuit. Both the on portion and the off portion of the flash are referred to herein as "half-cycles." In a flashing circuit, the duty cycle may be approximately 40 to 60 percent, meaning that during a single flash the signal lamp may be on for 40 to 60 percent of the time and off for the remaining time. Thus, either of the half-cycles may be longer depending on the particular flash circuit configuration. In an embodiment, the specified time interval is approximately equal to the longest half-cycle of a flash. If the current and/or voltage indicated by the time series data has been below the OFF threshold for the specified time interval, the process flow may advance to block 414 and the signal lamp state may be set to OFF.

At block 406, a determination is made regarding whether the current and/or voltage indicated by the time series data has been above the ON threshold for a specified time interval, which may indicate that the signal lamp is in the on state or the flashing state. The specified time interval may be based on the timing parameters of the corresponding flashing circuit. As described above in reference to block 404, the specified time interval may be approximately equal to the longest half-cycle of a flash. Because both portions of a flash may be above the ON threshold, any fluctuations in the current and/or voltage may be qualified to be below the amplitude-change threshold before the state of the signal lamp is set to ON. Thus, if the current and/or voltage indicated by the time series data has been above the ON threshold for the specified time interval, the process flow may advance to block 416.

At block 416, a determination is made regarding whether the current and/or voltage indicated by the time series data has undergone an amplitude variation greater than the amplitude-change threshold. If the current and/or voltage has not undergone an amplitude change greater than the amplitude-change threshold, the process flow may advance to block 418 and the signal lamp state may be set to ON. To summarize, if the signal lamp state 418 is set to ON at block 418, this indicates that the current or voltage has been above the ON threshold for the specified time interval and that any detected amplitude changes are below the amplitude-change threshold.

If, at block 416, the current and/or voltage has undergone an amplitude change greater than the amplitude-change threshold, the process flow may advance to block 420 to determine whether the time series data meets the flashing criteria used to identify the flashing state. The flashing criteria used at block 420 is discussed further below. If the flashing criteria are satisfied, the process flow may advance to block 426 and the signal lamp state may be set to FLASHING. Otherwise the process flow advances to block 424 and the signal lamp state is set to INDETERMINATE.

At block 408, a determination is made regarding whether the current and/or voltage indicated by the time series data has been fluctuating above and below the ON threshold, which may indicate a flashing state. If the current and/or voltage indicated by the time series data has been fluctuating above and below the ON threshold, the process flow may advance to block 422. At block 422, a determination is made regarding whether the current and/or voltage indicated by the time series data has undergone an amplitude variation greater than the amplitude-change threshold, as discussed above in relation to block 416. If the current and/or voltage has not undergone an amplitude change greater than the amplitude-change threshold, the process flow may advance to block 424 and the signal lamp state may be set to INDETERMINATE.

If at block 422, the current and/or voltage has undergone an amplitude change greater than the amplitude-change threshold, the process flow may advance to block 420. The detected amplitude variation may indicate that the signal lamp has gone into a flashing state. However, the amplitude variation may also indicate that the signal lamp has transitioned between the on state and the off state. Thus, at block 420 the time series data may be analyzed to determine whether the time series data meets the flashing criteria used to identify the flashing state. It will be appreciated from the above description that block 420 may be entered from block 416 if the current and/or voltage indicated by the time series data has been above the ON threshold for the specified time interval, or from block 422 if the current and/or voltage has been fluctuating above and below the ON threshold. In both cases, the time series data is analyzed to determine that any amplitude changes detected are above the amplitude-change threshold before proceeding to block 420. It will also be appreciated from the above description that the detected amplitude change will not be identified as corresponding to a flash if the peak current or voltage exhibited during the analyzed time frame does not exceed the ON threshold.

At block 420, the time series data is analyzed to determine whether the measured voltage and/or current data satisfy the flashing criteria to be considered a flash. Various types of flashing criteria and combinations thereof may be applied in a particular embodiment. In an embodiment, the flashing criteria may include timing criteria. The timing criteria may be satisfied, for example, upon detecting a specified number of amplitude changes greater than the amplitude-change threshold within a time interval, referred to herein as the "flash-detection time interval." The specified number of amplitude changes may be, for example, two, three, four, or more amplitude changes. The flash-detection time interval may be a fixed time interval determined based on the flashing rate and duty cycle implemented by the signaling control circuitry. For example, the flash-detection time interval may be computed according to the following formula:

$$T - N\left(\frac{60}{\text{Flashing Rate}}\right)$$

In the above formula, T equals the flash-detection time interval, N equals the specified number of amplitude changes for detecting a flash, and "flashing rate" equals the expected or known flashing rate implemented by the flashing circuitry. In an embodiment, the flash-detection time interval may be based on a flashing rate of approximately 35-75 flashes per minute and a duty cycle of approximately 40-60 percent. These exemplary flashing rate and duty cycle values are those that are currently required by federal regulations for railway wayside signal lamps.

In an embodiment, the timing criteria may be satisfied if the detected amplitude changes are consistent with the duty cycle implemented by the flashing circuitry. For example, given a duty cycle of 60 percent, the timing criteria may be satisfied if, over a time period corresponding to a possible flash, the voltage and/or current is above the ON threshold for approximately 60 percent of the time and drops below the amplitude-change threshold for approximately 40 percent of the time.

The flashing criteria may also include additional amplitude change criteria in addition to the timing criteria. For example, a determination may be made at block 420 to determine whether the peak current or voltage exceeds the average of the previous on portion and off portion of the previous amplitude change. If the peak current or voltage does not exceed the average of the previous on portion amplitude and previous off portion amplitude, the time series data may be identified as not meeting the flashing criteria for being considered a flash even if other criteria has been satisfied.

In an embodiment, minimum pulse width criteria may be applied to the time series data to prevent responding to noise or other types of pulses not related to flashing, such as test pulses that the lamp driving equipment may be generating. For example, pulses that are wider than the minimum pulse width may be qualified as pulses to be analyzed according to the flashing criteria discussed above. Pulses narrower than the minimum pulse width may be ignored. In an embodiment, the minimum pulse width may be approximately 100 milliseconds.

If the flashing criteria are not satisfied, the process flow may advance to block 424 and the signal lamp state may be set to INDETERMINATE. If the flashing criteria are satisfied, the process flow may advance to block 426 and the signal lamp state may be set to FLASHING.

At block 410, a determination is made regarding whether the time series data indicates that the voltage or current has been above the OFF threshold and below the ON threshold for the specified time interval. If the time series data indicates the current or voltage is above the OFF threshold and below the ON threshold for the specific time period, greater than the longest half-cycle of a flash, the process flow may advance to block 424 and the signal lamp state may be set to INDETERMINATE.

The method 400 may be repeated each time a new data point is added to the time series data or at some other regular time interval. As discussed above, the signaling aspect processor 110 may similarly determine the state of each of the signal lamps. The combination of signal lamp states is used to determine an overall signal aspect, which may be communicated to the transmitter 112 (FIG. 1).

In another embodiment, a method of determining the state of a signal lamp (e.g., of a signaling device) comprises receiving time series data corresponding to a voltage and/or current used to power the signal lamp. A state of the signal lamp alternates between an on state, an off state, and a flashing state. ("Between" or "alternates between" means that in a given time period (e.g., when the signaling device is operational), the lamp can be in any one of the states, and that from time to time, the lamp changes from one state to another, not that the lamp necessarily transitions between the states in the stated order.) The method further comprises determining the state of the signal lamp, based, at least in part, on the time series data. Determining whether the signal lamp is in the flashing state comprises determining whether the voltage and/or current varies by greater than a specified amplitude-change threshold over a specified number of transitions.

In another embodiment, a method of determining the state of a signal lamp comprises receiving time series data corresponding to a voltage and/or current used to power the signal lamp. A state of the signal lamp alternates between an on state, an off state, and a flashing state. The method further comprises determining the state of the signal lamp, based, at least in part, on the time series data. Determining whether the signal lamp is in the flashing state comprises determining whether an amplitude of the voltage and/or current varies by greater than a specified threshold over a specified number of transitions.

Another embodiment relates to a signaling aspect processor system. The system comprises a data storage device, a data acquisition unit, and a processing unit. The data acquisition unit is configured to receive time series data of a detected voltage and/or current being delivered to a signal lamp, and to save the time series data in the data storage device. A state of the signal lamp alternates between an on state, an off state, and a flashing state. The processing unit is configured to determine the state of the signal lamp based on the time series data. The processing unit is configured to determine whether the signal lamp is in a flashing state by determining whether the voltage and/or current varies by greater than a specified amplitude-change threshold over a specified number of transitions.

In another embodiment of the signaling processor system, the system is as described in the section immediately above, and the data acquisition unit is further configured to detect the voltage and/or current being delivered to the signal lamp.

In an embodiment, "on" or "in an on state" refers to a lamp being active (e.g., lit), and not flashing. "Off" or "in an off state" refers to a lamp being inactive (e.g., unlit), and not flashing. "Flashing" or "in a flashing state" refers to a lamp periodically switching between being active (e.g., lit) and being inactive (e.g., unlit), multiple times within a designated time period, as described above. When flashing, the portion when the lamp is active is the "on" portion, and the portion when the lamp is inactive is the "off" portion.

In an embodiment, the time series data relates to a measured/sensed lamp voltage. In another embodiment, the time series data relates to a measured/sensed lamp current. In another embodiment, the time series data relates to measured/sensed current and voltage.

Figure 5:
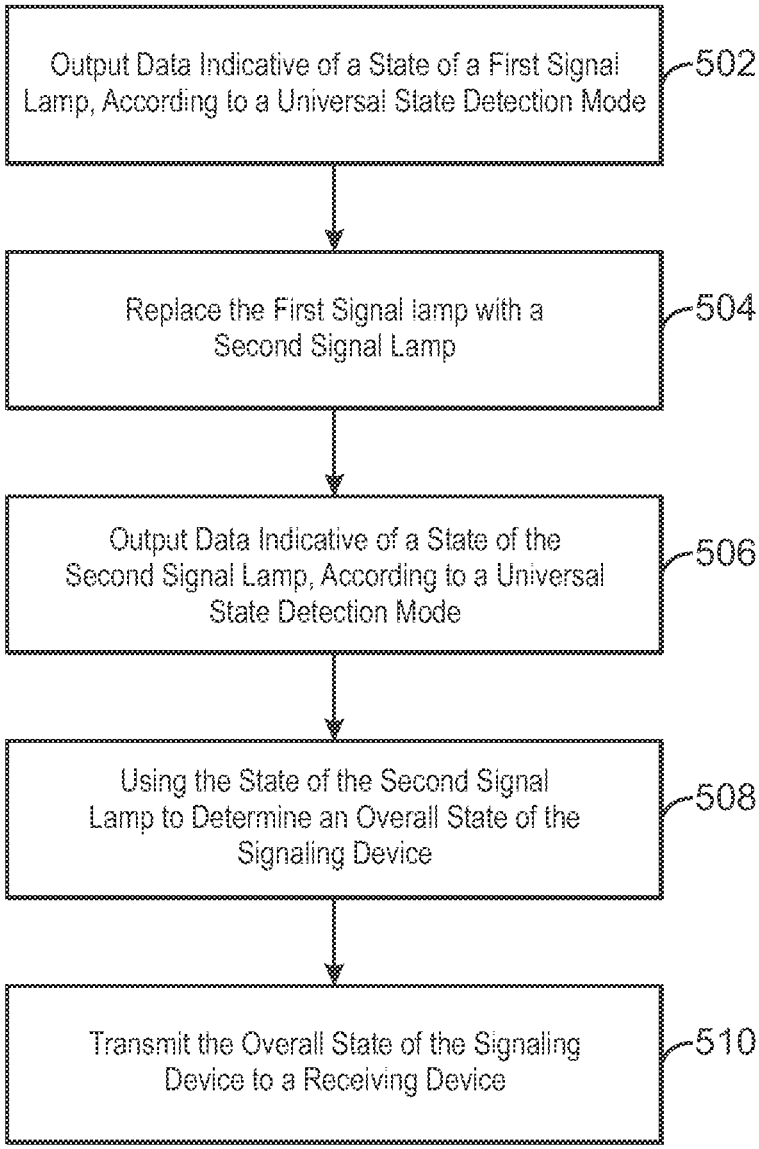
FIG. 5 is a process flow diagram summarizing a method of operating a signaling device, according to an exemplary embodiment of the invention.

FIG. 5 is a process flow diagram summarizing a method of operating a signaling device, according to an exemplary embodiment of the invention. The method 500 may be implemented in a signaling system such as the railway signaling system of FIG. 1. The signaling system may be configured to control the respective states of the first and second signal lamps between a flashing state, an on state, and an off state.

At block 502, data indicative of a state of a first signal lamp of the signaling device may be output. For example, the data may be output to a signaling aspect processor. The state of the first signal lamp may be output according to a universal state detection mode, which is operable for a plurality of differently-configured signal lamps.

At block 504, the first signal lamp may be replaced with a second signal lamp. The second signal lamp may be differently-configured compared to the first signal lamp. For example, the second signal lamp may be of a different wattage or a different type. In other words, the second signal lamp may be an LED signal lamp, whereas the first signal lamp may be an incandescent lamp.

At block 506, data indicative of a state of a second signal lamp of the signaling device may be output, for example, to a signaling aspect processor. As described in relation to block 502, the state of the second signal lamp may be output according to the universal state detection mode, which is operable for the second signal lamp even if the second signal lamp is differently-configured, for example, a different type or different wattage. As such, no additional calibration, adjustment of thresholds, or other human input is applied to adjust the system for the differently-configured signal lamp. Rather, the same universal state detection mode is used for both the first signal lamp and the second signal lamp. In an embodiment, the universal state detection mode is the process described in relation to FIG. 4.

At block 508, the state of the second signal lamp may be used to determine an overall state of the signaling device. The overall state of the signaling device determines the vehicle operator's authority to move, the presence of hazards, as well as other information. At block 510, the overall state of the signaling device may be transmitted to a receiving device of a rail vehicle, a central control station, or other monitoring station.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions, values, and types of materials described herein are intended to illustrate embodiments of the invention, they are by no means limiting and are exemplary in nature. Other embodiments may be apparent upon reviewing the above description. The scope of the invention should, therefore, be determined with reference to the appended claims, along with the full scope of equivalents to which such claims are entitled.

In the appended claims, the terms "including" and "in which" are used as the plain-English equivalents of the respective terms "comprising" and "wherein." Moreover, in the following claims, the terms "first," "second," "third," "upper," "lower," "bottom," "top," "up," "down," etc. are used merely as labels, and are not intended to impose numerical or positional requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

As used herein, an element or step recited in the singular and proceeded with the word "a" or "an" should be understood as not excluding plural of said elements or steps, unless such exclusion is explicitly stated. Furthermore, references to "one embodiment" of the invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

Since certain changes may be made in the above-described system and method for determining railway signal state, without departing from the scope of the invention herein involved, it is intended that all of the subject matter of the above description or shown in the accompanying drawings shall be interpreted merely as examples illustrating the inventive concept herein and shall not be construed as limiting the invention.

What is claimed is:

1. A method of determining the state of a signal lamp, comprising:

receiving time series data corresponding to an electrical signal used to power a signal lamp, and a state of the signal lamp can switch from one of the following states to another of the following states: an on state, an off state, and a flashing state; and determining the state of the signal lamp, based at least in part on both the time series data and an amplitude value of the electrical signal relative to an amplitude-change threshold value over a determined number of amplitude changes.

2. The method of claim 1, wherein determining whether the signal lamp is in an on state comprises determining whether the electrical signal exceeds a specified ON threshold value for a determined time interval, and whether the electrical signal differs by an amount that is more than the specified amplitude-change threshold value.

3. The method of claim 1, wherein determining whether the signal lamp is in an off state comprises determining whether the electrical signal is at a value that is below a determined OFF threshold value for a specified time interval.

4. The method of claim 1, further comprising determining the state of the signal lamp using an ON threshold value, an OFF threshold value, and the amplitude-change threshold value, wherein the ON threshold value, the OFF threshold value, and the amplitude-change threshold value are universal threshold values.

5. The method of claim 1, wherein the signal lamp is one of a plurality of signal lamps used in an integrated signaling device or in a system of communicating signaling devices, the method further comprising determining an overall state of the signaling device or the system of communicating signaling devices based on respective states of the signal lamps and transmitting the overall state to a receiving device.

6. The method of claim 1, further comprising identifying as the flashing state based on a change in the electrical signal that is greater than the specified amplitude-change threshold value over the specified number of amplitude changes within a specified flash-detection time interval.

7. The method of claim 1, further comprising determining if the signal lamp is in the FLASHING state based on determining if an on portion and an off portion of a possible flash are consistent with a reference flash rate and a duty cycle.

8. A system, comprising:

a receiver for time series data of a detected electrical signal being delivered to a signal lamp, and a state of the signal lamp can switch from one at least one of the following states to another of the following states: an on state, an off state, and a flashing state; and a controller in communication with the receiver, and that determines the state of the signal lamp based on the time series data, and determines whether the signal lamp is in a flashing state based on an amplitude value of the electrical signal relative to an amplitude-change threshold value over a specified number of amplitude changes.

9. The system of claim 8, wherein the data acquisition unit communicates with a sensor or an array of sensors that can detect the electrical signal being delivered to the signal lamp.

10. The system of claim 8, wherein the processing unit is configured to determine whether the signal lamp is in an on state by determining whether electrical signal exceeds a specified ON threshold value for a specified time interval and whether the electrical signal differs from the ON threshold value by an amount that is more than the specified amplitude-change threshold value.

11. The system of claim 8, wherein the processing unit is configured to determine whether the signal lamp is in an off state by determining whether the electrical signal falls below a specified OFF threshold for a specified time interval.

12. The system of claim 8, wherein the controller further determines the state of the signal lamp using an ON threshold value, an OFF threshold value, and an amplitude-change threshold value, wherein the ON threshold value, the OFF threshold value, and the amplitude-change threshold value are universal threshold values.

13. The system of claim 8, wherein the controller further determines the state of the signal lamp as the flashing state if the electrical signal has a value that is greater than the specified amplitude-change threshold value over the specified number of amplitude changes within a specified flash-detection time interval.

14. The system of claim 13, wherein the specified flash-detection time period is based on the flashing rate and the duty cycle implemented by a corresponding flashing circuit.

15. The system of claim 8, wherein the controller further determines whether the signal lamp is in a flashing state by determining whether an on portion and an off portion of a possible flash are consistent with a flash rate and duty cycle employed by a corresponding flashing circuit.

16. A system for determining a state of a signaling device, comprising:

a signal lamp configured to indicate a condition of a railway as a function of a state of the signal lamp, the signal lamp controlled by the signaling device;

a sensor coupled to the signal lamp and configured to detect an electrical signal powering the signal lamp; and a signaling aspect processor coupled to the sensor and comprising:

a data storage device;

a data acquisition unit configured to receive the electrical signal detected by the sensor and save time series data of the electrical signal to the data storage device; and a processing unit configured to determine the state of the signal lamp based on the time series data, wherein the state of the signal lamp is identified as flashing if the electrical signal varies by greater than a specified amplitude-change threshold over a specified number of amplitude changes within a specified flash-detection time interval.

17. The system of claim 16, wherein the processing unit is configured to identify the state of the signal lamp as on if the electrical signal exceeds a specified ON threshold for a specified time interval and the voltage and/or current does not vary by more than the specified amplitude-change threshold.

18. The system of claim 16, wherein processing unit is configured to identify the state of the signal lamp as off if the electrical signal falls below a specified OFF threshold for a specified time interval.

19. The system of claim 16, wherein the processing unit is configured to identify the state of the signal lamp using an ON threshold, an OFF threshold, and the amplitude-change threshold, wherein the ON threshold, the OFF threshold, and the amplitude-change threshold are universal thresholds.

20. The system of claim 16, wherein the processor is configured to determine an overall state of the signaling device based on the state of the signal lamp.

21. The system of claim 20, comprising a transmitter operatively coupled to the signaling aspect processor and configured to transmit the overall state of the signaling device to a receiving device of a rail vehicle, a central control station, or other monitoring station.

22. A signaling aspect processor system, comprising:

a data acquisition unit configured for operable connection with a sensor coupled to a signal lamp of a signaling device, the signaling device configured to control a state of the signal lamp between an on state, an off state, and a flashing state; and a processing unit configured to output data indicative of the state of the signal lamp, according to a universal state detection mode, the signal lamp comprising any of a plurality of differently-configured signal lamps.

* * * * *